US005123321A

United States Patent [19]

Caught

[11] Patent Number: 5,123,321

[45] Date of Patent: Jun. 23, 1992

[54] PIANO

[76] Inventor: Anthony G. Caught, 22 Osterman St., Coconut Grove N.T., Australia, 0810

[21] Appl. No.: 538,839

[22] Filed: Jun. 15, 1990

Related U.S. Application Data

[63] Continuation-in-part of Ser. No. 477,961, May 30, 1990.

[30] Foreign Application Priority Data

Dec. 1, 1987 [AU] Australia ..... Pi5682

[51] Int. Cl.[5] ..... G10C 3/18

[52] U.S. Cl. ..... 84/242; 84/253

[58] Field of Search ..... 84/236-243, 84/247-253

[56] References Cited

U.S. PATENT DOCUMENTS

| | | | |
|---|---|---|---|
| 2,524,835 | 10/1950 | Ringholz | 84/253 |
| 3,946,635 | 3/1976 | Atsuta | 84/242 |
| 4,119,008 | 10/1978 | Kimble | 84/242 |

*Primary Examiner*—L. T. Hix
*Assistant Examiner*—Howard B. Blankenship
*Attorney, Agent, or Firm*—Hayes, Soloway, Hennessey & Hage

[57] ABSTRACT

An improved piano which offers improved repetitive playing characteristics, a clearly distinguishable set off pressure, and an improved player touch, enabling the player to better control the strength and sound quality produced. The piano action includes biasing means which causes a different moment of force on the hammer butt depending on the position of the hammber butt as it rotates from the rest position to the string striking position. A piano made in accordance with the present invention includes an improved bridge and soundboard arrangement at an upper end of an upright piano's plate comprising a bridge rail connected to a soundboard; a suspension bridge supported along a first edge portion of the bridge rail and supported along a second edge portion opposite the first edge portion by the plate; and a bridge bearing in contact with the suspension bridge and arranged to bear against the strings to transfer vibrations from the strings to the soundboard. This improved bridge and soundboard arrangement enables an increase in the speaking length of the strings, reduces the force transmitted to the soundboard by the strings, and allows an upright piano to only require a single bridge arrangement.

13 Claims, 8 Drawing Sheets

"PRIOR ART"

"PRIOR ART"

PIANO

This is a continuation of application Ser. No. 477,961, filed May 30, 1990.

FIELD OF THE INVENTION

This invention relates to pianos and in particular to an upright piano. However, it will be appreciated that the invention is not limited to this particular field of use.

BACKGROUND OF THE INVENTION

Generally, upright pianos incorporate a series of piano action assemblies each corresponding to a key. Each action assembly is arranged such that the depression of a key causes a hammer associated with the piano action assembly to strike a corresponding string of the piano.

In conventional upright piano actions this is achieved by having the hammer assembly arranged in a relatively upright orientation with a butt at its lower end which is rotatably mounted on the main action rail. The hammer assembly also incorporates a hammer head remote from the butt and is arranged to rotate from a rest position to a string striking position wherein the hammer head strikes the string.

The hammer assembly is caused to rotate on depression of the key by an assembly incorporating a wippen and a jack. The jack interconnects the wippen and the hammer butt and is arranged to engage the hammer butt at its lower end at a position off set from the point of pivot of the hammer butt. The jack is caused to apply an upward pressure on the hammer butt when in the rest position which causes the hammer butt to rotate from the rest position to the string striking position. The jack is caused to apply this upward pressure by depression of the key which imparts a force through the wippen to the jack.

Furthermore, the jack is caused to disengage from the hammer butt as it rotates from the rest to the string striking position. The point at which this occurs is the "set off" point and the pressure that is required on the key to cause the jack to disengage is called the "set off" pressure.

Biasing means act on the hammer butt to return the hammer from the string striking position to the rest position. In addition, a jack spring acts on the jack to cause it to re-engage the hammer butt once it has disengaged the hammer butt.

A player of the piano is able to sense the "set off" point because as the hammer rotates under the influence of the jack, a resisting force is applied to the hammer butt by the biasing means. This resisting force is transmitted through the jack and wippen to the key. However, on release of the jack from the hammer butt, this resisting force is no longer transmitted to the key. Therefore, as the jack is released from the hammer butt, the player senses a changing of pressure on the key.

To enable the jack to re-engage the hammer butt it is necessary to either completely release the key or the jack spring has to be highly tensioned such that it overcomes the biasing force acting on the hammer butt. If the jack spring does impart a force which is greater than the biasing force, then the key does not have to be fully released, as the jack spring is able to rotate the hammer butt towards the string striking position to a position wherein the jack is able to re-engage the hammer butt.

In the repetitive playing of a piano, the keys are not fully released. Consequently, if a piano is to have good repetitive playing characteristics, the piano should be arranged such that the jack spring is tensioned to a level that is greater than the biasing means when the hammer butt is near the rest position to enable the jack to re-engage the hammer butt without the key being fully released.

In conventional upright pianos, to enable good repetitive characteristics, the biasing means has been arranged to apply a relatively low force on the hammer. In this way the jack spring is able to overcome this force to enable the jack to re-engage the hammer butt when the key is not fully released.

However, by having the biasing means only apply a relatively low force on the hammer butt, the pressure transmitted to the key by the resisting force of the biasing means as the hammer rotates from the rest to the string position is low. Consequently, the "set off" pressure is low and the "set off" point is not clearly distinguished. This is in contrast to a grand piano key action wherein the "set off" pressure is much greater and the "set off" point is more clearly distinguished. Because of this the key action of a grand piano has an improved "touch" which enables the player to control the strength and sound much more accurately.

It is an object of a first aspect of the present invention to provide an upright piano action which more clearly distingishes the "set off" point.

It is a further object of a first aspect of the present invention to provide a piano action which has improved repetitive playing characteristics.

SUMMARY OF THE INVENTION

According to the first aspect of the present invention there is provided an upright piano action for a piano incorporating a piano frame, the action comprising a hammer butt rotatably secured relative to the frame, a shank mounted to the hammer butt and supporting a hammer head thereon remote from the hammer butt, the hammer butt being rotatable between a rest position wherein the hammer head is remote from a string of the piano and a string striking position wherein the hammer head strikes the string, a jack engaging the hammer butt when in the rest position and being arranged to cause the hammer butt to rotate from its rest position to the string striking position by depression of a respective key of the piano, biasing means acting on the hammer butt to bias the hammmer butt from the string striking position to the rest position, the biasing means being arranged to apply a first force at a first location on the hammer butt when the hammer butt is in or adjacent its rest position and to apply a second force at a second location on the hammer butt when the hammer butt rotates from the rest position to an intermediate position between the rest and string striking positions, the first location on the hammer butt being remote from the second location and wherein the moment of force generated by the biasing means to bias the hammer butt from the string striking position to the rest position is greater when the biasing means applies the second force on the second location of the hammer butt, than when the biasing means applies the first force on the first location of the hammer butt.

By providing a biasing means which causes a different moment of force on the hammer butt depending on the position of the hammer butt as it rotates from the rest position to the string striking position, the piano action of the present invention can be arranged to have good repetitive playing characteristics as the biasing means imparts only a low moment of force at or adjacent the rest position, yet also provides a much greater resisting force to enable a high "set off" pressure to be attained which gives rise to a clearly distinguished "set off" point.

In a further aspect, the present invention relates to a bridge and soundboard arrangement which is suitable for both grand and upright pianos.

The bridge is used to transfer the vibration of the strings of the piano to the soundboard. The soundboard acts as an amplifier and resonator such that the sound caused by the strings vibrating can be more easily heard. Further, the point of contact of the bridge with the string defines the length of the portion of the strings which are allowed to freely vibrate (the speaking length).

FIG. 5 shows a conventional soundboard and bridge arrangement of an upright piano. As can be seen, the bridge arrangement 100 comprises a bass bridge 101 and treble bridge 102 both of which are directly secured to the soundboard 103 and once secured are unable to be relocated.

FIG. 6 shows a detailed view of a conventional bass bridge. As illustrated, the bass bridge 101 has a stepped arrangement such that the base plate 104 which contacts the soundboard 103 is off set from the bridge pins 105 which contact the strings. The bass bridge is arranged in this way to enable the bridge to apply force on the soundboard 103 in an active area (wherein the soundboard is free to resonate) while enabling the speaking length of the strings to remain as long as possible.

Several problems exist with prior art bridge arrangements. Firstly, each string is arranged in tension to exert a force of approximately 4.5 pounds pressure on the respective bridge and this force is theoretically transferred directly to the soundboard. As a result, the soundboard is required to have strengthening ribs to prevent it from buckling or bowing under the pressure applied by the strings to the bridge. By incorporating the ribs the quality of the sound produced from the soundboard is decreased as the ribs divide the soundboard into sections thus restricting the strings vibration to affect the soundboard evenly.

A second problem that exists in conventional bridge and soundboard arrangements is that conventional bridge arrangements do not maximise the speaking length of the strings. As, the bridge is required to contact an active area of the soundboard, conventional bridges have been positioned in a location intermediate the ends of the strings. Furthermore, in conventional bridges the contact point with the string has been approximately above or only slightly offset from the contact point with the soundboard. Consequently, the speaking length of the strings have reduced because of the position of the bridge.

A secondary function of the bridge arrangement is to act as a vibration mixer. In this respect, if one note is sounded, the bridges causes other strings to vibrate in sympathy creating a tonal and volume change in the note sounded. This effect is in force when sustained or the loud pedal is depressed which lifts the dampers off the strings.

However, in conventional bridge arrangements this effect is limited because the two bridges are not connected. This lack of effect is particularly noted at the break between the bass and treble strings, ie. the lower end of the treble bridge and the upper end of the bass bridge.

A first object of the further aspect of the present invention is to provide a bridge arrangement which enables an increase in speaking length of the strings.

The second object of the further aspect of present invention is to provide a bridge arrangement that reduces the force transmitted to the soundboard by the strings.

A third object of the further aspect of present invention is to provide a single bridge arrangement for an upright piano.

Accordingly, in a further aspect, the present invention provides a bridge arrangement for a piano having a soundboard, and string supported by a plate, the bridge arrangement comprising: a bridge rail connected to the soundboard; a suspension bridge supported along a first edge portion of the bridge rail and supported along a second edge portion opposite the first edge portion by the plate; and a bridge bearing in contact with the suspension bridge and arranged to bear against the strings to transfer vibrations from the strings to the soundboard.

In a preferred embodiment, the bridge arrangement according to the present invention is incorporated at an upper end of the plate of an upright piano and is arranged to replace the traditional bass and treble bridge arrangements.

Notwithstanding any other forms that may fall within its scope, the preferred forms of the invention will now be described by way of example only with reference to the accompanying drawings in which:

DETAILED DESCRIPTION OF THE PREFERRED EMBODIMENTS OF THE INVENTION

Figure 1:
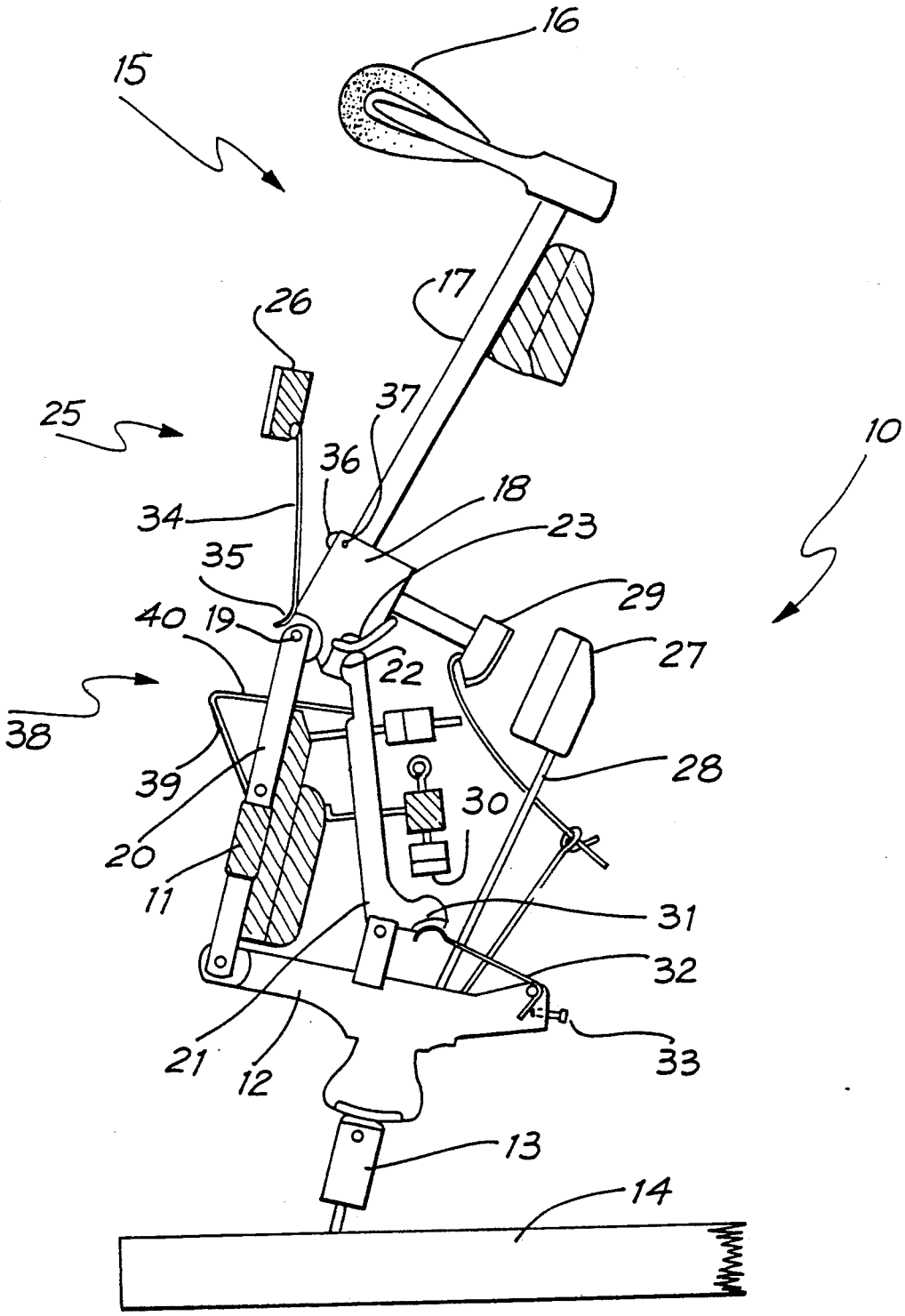
FIG. 1 shows a first embodiment of the piano action of the piano of the present invention.

FIG. 1 shows a piano action 10 in a state of rest. As can be seen, a main action rail 11 is provided which is fixed relative to the piano frame (not shown). A wippen 12 is pivotally mounted to a lower end of the main action rail 11 and is also connected through linkage assembly 13 to the key 14. With this arrangement, depression of the key 14 activates the piano action from a state of rest and induces an upward movement of the wippen 12 causing the wippen to pivot around the main action rail 11.

A hammer assembly 15, comprising a hammer head 16, shank 17 and hammer butt 18 is pivotally mounted about a pivot axis 19 of the hammer butt 18 to a hammer flange 20, which is rigidly connected to an upper end of the main action rail 11.

Figure 3:
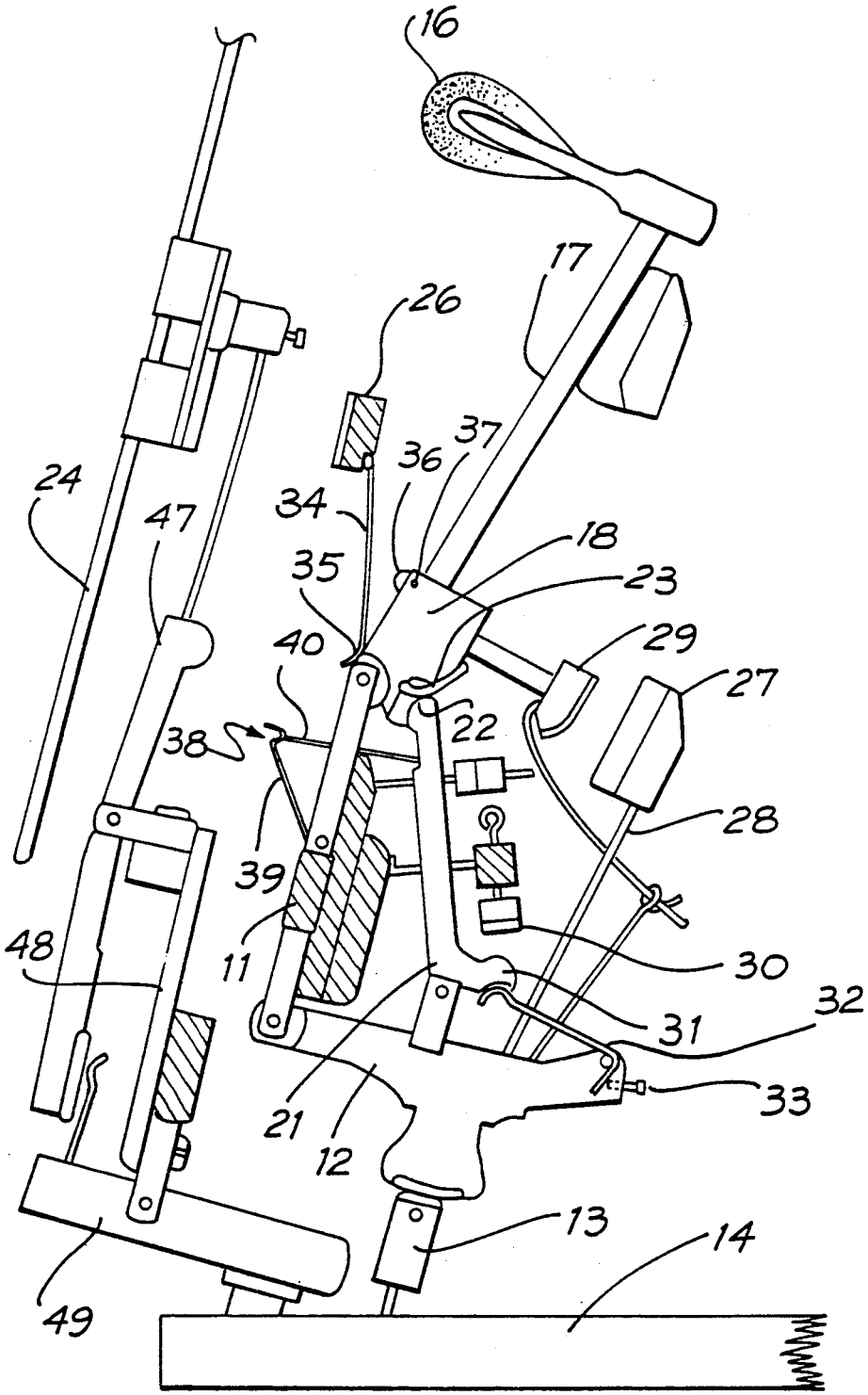
FIG. 3 shows the damper assembly in conjunction with the piano action of FIG. 1.

A jack 21 interconnects the hammer butt 18 and wippen 12. The jack 21 is pivotally mounted at its lower end to the wippen 12 and is engaged at its upper end 22 to a lower arcuate surface 23 of the hammer butt 18. The jack 21 is arranged such that upward movement of the wippen 12 induced by the depression of the key 14 causes the jack 21 to apply an upward force to the arcuate surface 23 of the hammer butt 18. As the arcuate surface 23 is offset from the pivot axis 19, the hammer is caused to rotate about pivot axis 19 by the upward movement of the jack 21 and is able to rotate the hammer butt 18 from the rest position to a string striking position (not shown) wherein the hammer head strikes the strings 24 (FIG. 3).

The rotation of the hammer butt to the string striking position is resisted by biasing means 25 attached to a return spring rail 26 and arranged to bias the hammer to return to its rest position.

A back check block 27 is mounted by wire 28 to an end of the wippen 12 remote from the pivot connection of the wippen 12 to the main action rail 11. On movement of the wippen 12, due to depression of the key 14, the back check 27 moves towards the hammer butt 18. A back stop 29 extends from the rear of the hammer butt 18 and is arranged such that when the key 14 is fully depressed, the back check 27 is adjacent the back stop 29.

An adjustable setoff button 30 extends from the main action rail 11 and is arranged to engage an arm 31 of the jack 21 as the jack rises due to movement of the wippen 12. The setoff button 30 is adjusted such that it will engage the arm 31 of the jack when the key 14 is depressed a predetermined distance.

As the setoff button 30 contacts the arm 31 of the jack 21, further upward movement of the wippen 12 causes the jack 21 to rotate around its pivot connection to the wippen 12. This pivotal movement of the jack causes the upper end 22 of the jack 21 to move away from the arcuate surface 23 of the hammer butt 18, thereby releasing the jack from hammer butt and consequently, removing pressure from the jack on the hammer butt 18. The piano action is arranged such that under inertia the hammer butt continues to move to the string striking position.

The pressure applied to the key 14 which is required to disengage the jack 21 from the hammer butt 18 is called the setoff pressure and the point at which the jack disengages the hammer butt 18 is called the setoff point.

A spring 32 for the jack 21 is located beneath the arm 31 of the jack 21 and is connected to the wippen 12. An adjustment screw 33 is located within the wippen 12 to adjust the tension of the spring 32. The jack spring 32 resists the pivoting of the jack away from the hammer butt 18 which occurs once the jack 21 contacts the setoff button 30.

After the key has been depressed passed the setoff point the hammer moves to the string striking position and then returns to its rest position under the influence of the biasing means 25. Furthermore, on release of the key 14 the wippen 12 moves downwardly relative to the main action rail 11, causing the jack arm 31 to disengage the setoff button 30 and also enabling the top 22 of the jack 21 to slide down the lower surface of the hammer butt 18 under the influence of the jack spring 32 to its operative position where it re-engages the arcuate surface 23 of the hammer butt 18.

In the embodiment as illustrated in FIG. 1, the biasing means 25 comprise a wire spring 34 which is connected at a first end to the spring return rail 26. The wire spring 34 extends outwardly from the return rail 26 and is arranged to engage the hammer butt at a first location 35 when the hammer butt is in its rest position. The wire spring 34 applies a force to the hammer butt 18 at the first location 35 and this causes a moment of force to be generated on the hammer butt 18 around the pivotal axis 19. With this moment of force the hammer butt is biased into its rest position.

A bearing 36 is secured to the hammer butt 18 and is arranged in a second location 37 remote from the pivot axis 19 of the hammer butt 18. The bearing 36 is arranged such that as the hammer moves from its rest position to a string stiking position the bearing engages the wire spring 34.

As the bearing 36 contacts the wire spring 34, a force is imparted onto the hammer butt at the second location 37. This force imparted at the second location creates a larger moment of force to act on the hammer butt about the pivot axis 19 than was generated by the force applied at the first location 35. This is primarily due to the greater distance from the second location 37 to the pivot axis 19, but another contributing factor is that the bearing 36 contacts the wire spring 34 at a point which is closer to the spring return rail 26 than the point the hammer butt contacts the wire spring at the first location, and therefore, the spring is stiffer and imparts a greater force at the second location 37 than the force imparted at the first location 35.

By generating this larger moment of force acting on the hammer butt due to the bearing 36 contacting the wire 34, a greater resistance to the rotation of the hammer butt to the string stiking position under the action of the jack occurs. This greater resistance causes a corresponding force to be imparted through the jack 21 to the key 14 which results in a greater pressure being required to depress the key which is felt by a player of the key.

The size of the moment of force caused by the bearing 36 contacting the wire 34 as well as the position at which the hammer butt, as it rotates from the rest position to the string striking position, contacts the wire 34 can be easily varied by merely adjusting the location of the bearing 36 on the hammer butt 18 to therefore move the second location 37 and/or move the point at which the bearing 36 contacts the wire 34.

It is preferred that the bearing is timed to contact the wire spring 34 immediately prior to the jack 21 being released from the hammer butt. With this arrangement, there is a sudden increase in the pressure felt by the player when the bearing 36 contacts the wire 34 followed by a sudden decrease of pressure felt by the player on release of the jack 21 from the hammer butt 18. This occurs as the pressure on the key induced as a result of the larger moment acting on the hammer butt due to the contact of the wire spring 34 with the bearing 36, is suddenly removed. The removal of this pressure is again felt by the player of the piano. Consequently, there is an increase in setoff pressure and the player is far more easily able to distinguish the setoff point. In this way, upright piano action 10 is more akin to a grand piano.

Furthermore, the biasing means 25 has benefits in improving repetition characteristics of the piano action.

In the repetitive playing of the key 14, the key is not fully released, and although the hammer is able to return to its rest position under the influence of the biasing means 25, the wipen has not moved sufficiently in a downward direction to enable the jack 21 to contact the arcuate surface 23. Therefore, to enable repetition of playing when the key is not fully released it is necessary for the jack spring 32 to urge the jack 21 against the hammer butt 18 to cause the hammer butt to rotate sufficiently towards the stiking string position to enable the jack to contact the arcuate surface 23.

To enable rotation of the hammer butt towards the striking string position to occur, the force of the jack 21 must be greater than the biasing means 25 when in the rest position. To faciltate this, the biasing means 25 is arranged such that when in the rest position, only a relatively small moment of force is imparted on the hammer butt urging it towards the rest position. This is achieved by ensuring that the first location 35 wherein the wire spring 34 contacts the hammer butt is adjacent the pivot axis 19.

In FIG. 1, repetition spring means 38 in the form of repetitive spring 39 and repetition cord 40 act between the main action rail 11 and the jack 21. The repetition spring means is arranged to assist the jack in returning the jack 21 to its operative position such that the combined effect of the repetition spring means 38 and jack spring 32 is greater in tension when the jack is not in its operative position then the biasing means 25 when in the rest position. In this way, the top 22 of the jack 21 is able to supply sufficient force on the hammer butt 18 to counteract the biasing force of the biasing means 25 and thereby enables the hammer not to return to its rest position but to be pivoted around the pivot axis 19 sufficiently to enable the top 22 of the jack to re-engage with the arcuate surface 23 in an operative position to thereby enable repetitive playing of the key without the key needing to be fully released.

Furthermore, as the jack 21 is caused to pivot when contacting the setoff button 30, the jack 21 moves away from the hammer butt 18 and consequently, there is an increase in tension in the repetition spring 39. As the key 14 is released the extra tension of the repetition spring 39 pulls the jack 21 back into its engaged position for faster repetition.

Even though the jack spring 32 and repetition spring 39 in combination when the jack 21 is not in its operative position is greater than the biasing means 25 when in the rest position there is no danger that the jack spring and repetition spring alone would cause the hammer to rotate to the string striking position. This is so because as the hammer butt 18 begins to rotate under the force of the jack spring and repetition spring, the bearing 36 on the hammer butt 18 is caused to contact the wire spring 34. Once this occurs, further rotation of the hammer butt 18 solely under the influence of the jack spring 32 or repetition spring 39 would be prevented. In this way the biasing means 25 enables a greater force to act on the jack to improve the repetitive playing characteristics of the piano action 10.

Figure 2:
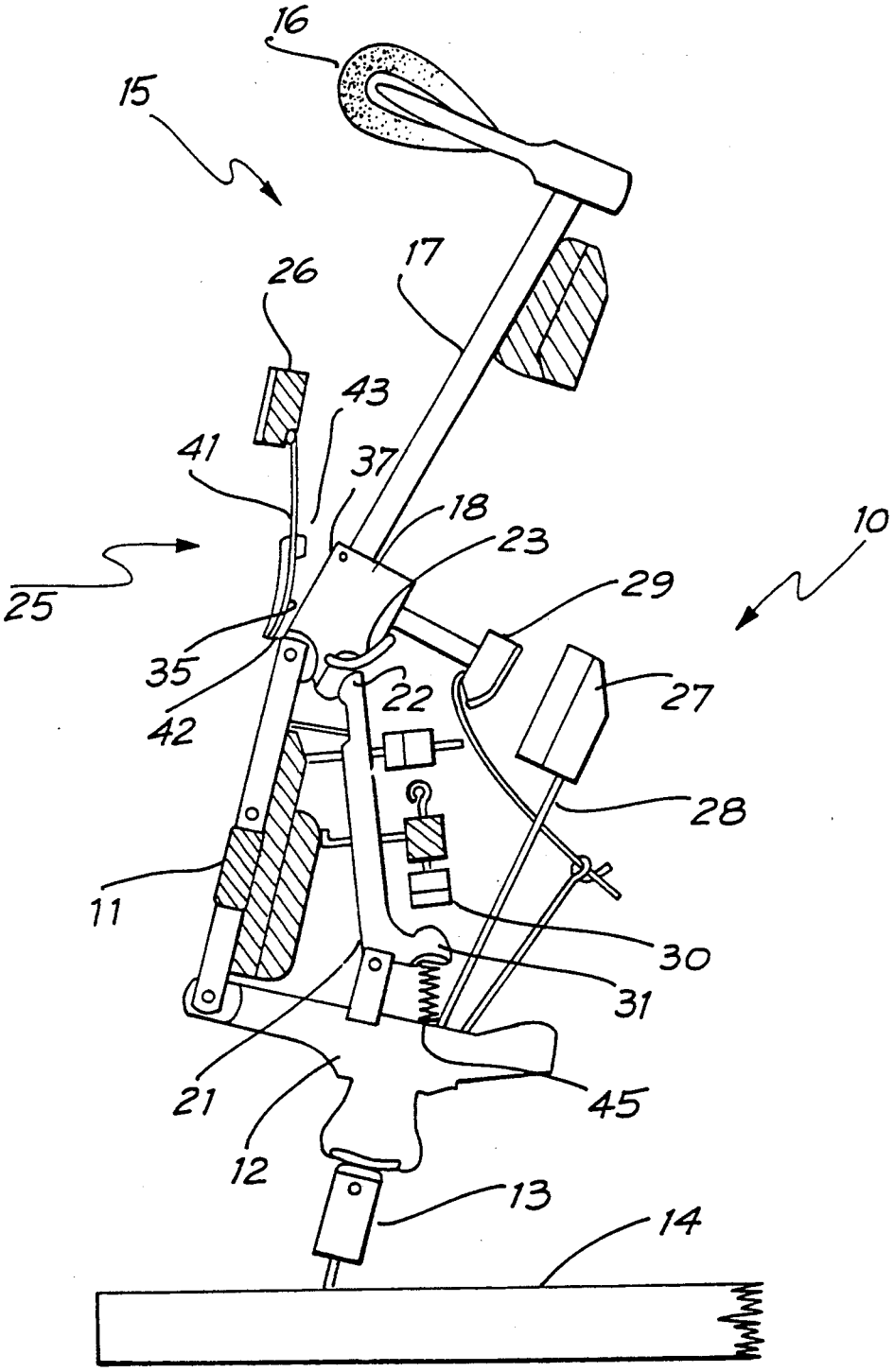
FIG. 2 shows a second embodiment of the piano action of the piano of the present invention.

FIG. 2 shows a second embodiment of the piano action according to the present invention. The second embodiment differs from the first embodiment in the arrangement of the biasing means 25 and the jack spring 32.

As illustrated in FIG. 2, the biasing means 25 comprises a specifically modified wire spring 41 which incorporates two bearing surfaces (42 and 43). The first bearing 42 is arranged to engage the hammer butt 18 at the first location 35 when the hammer butt is in a rest position. The second bearing 43 is arranged to engage the hammer butt 18 at the second location 37 as the hammer butt 18 rotates to an intermediate position between the rest position and the string striking position. With the specially modified wire spring 41 it is no longer necessary to provide the bearing 36 on the hammer butt as illustrated in the first embodiment.

Furthermore, in the second embodiment the jack spring 44 comprises a highly tensioned coil spring 45. With this arrangement it is no longer necessary to incorporate the repetition spring means 39 as the coil spring 45 provides sufficient force to overcome the force imparted by the biasing means 25 at the first location.

Although not shown, an adjustable wire spring similar to adjustable jack spring 32 in FIG. 1 may be incorporated to assist the coil spring 45 for finer control of the jack springs tension.

In an upright piano, the action and keyboard is in a fixed position. When the soft pedal is activated, the hammers move closer to the strings. In a grand piano, the action and keyboard are fixed together and when the soft pedal is activated, the action and keyboard move sideways and the hammers strike a lesser amount of strings.

The touch changes in an upright piano when the soft pedal is activated; in a grand piano, the touch does not change when the soft pedal is activated.

In the embodiment shown in FIG. 3, the keyboard and action move sideways to be more similar to a grand piano, this is done by separating the dampers from the main rail of the upright action.

FIG. 3 shows the piano action of FIG. 1 with an improved damper assembly. The damper 47 is locked on the damper main rail 48 which is attached to the piano plate (attachment not shown). The damper is activated when the key 14 rises at the string end of the piano, as the actuator 49 is caused to pivot around the damper main rail 48. This imparts a movement to the damper 44 towards the string 24.

An important distinction between the prior art damper arrangement and the damper arrangement of FIG. 3 should be noted. Previously, the damper had been operated by movement of the wippen 12. In this embodiment, as the dampers are fitted to a separate rail (damper rail 48), it is possible for the damper to be operated directly by the respective key 14. In this way, the operation of the dampers can be adjusted to reduce the key pressure required to operate the dampers so that the damper resistance does not adversely affect the feel of the action. Also, as the damper arrangement is fitted to a separate rail from the action and operated by direct contact with the keys, the damper arrangement can be fitted separately and prior to the fitting of the action so that the individual dampers can be separately adjusted and separately regulated to ensure that each damper operates at the desired key position and key pressure before the action is fitted. Usually, it is desirable for the damper to start to lift when its key has reached half of its travel.

Figure 4:
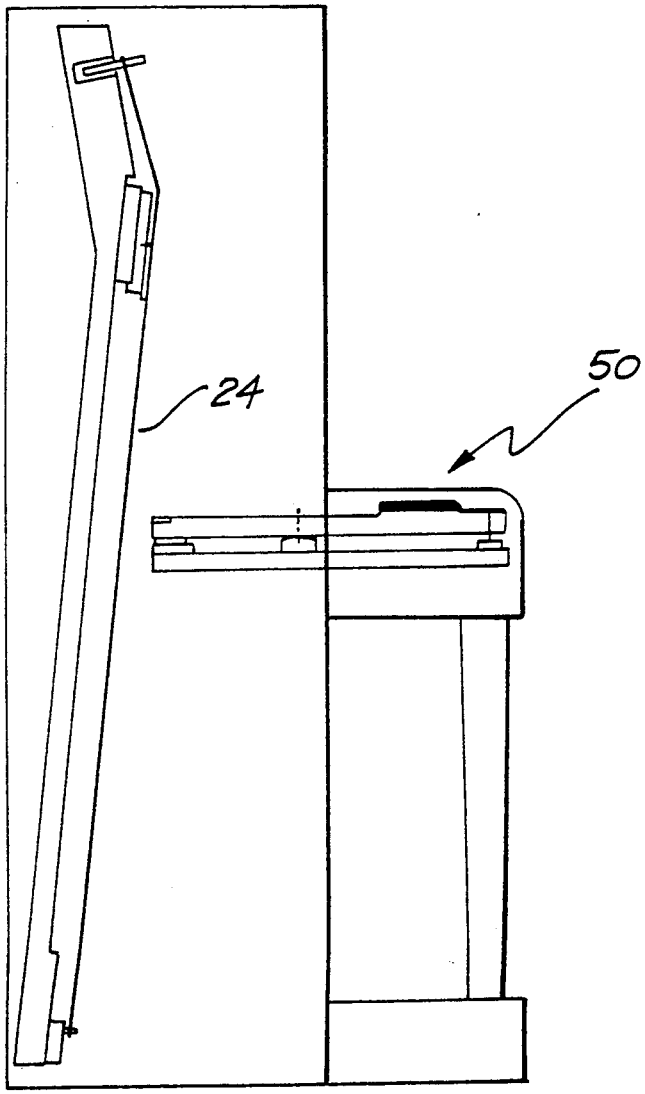
FIG. 4 shows a diagrammtic end section of the piano.
Figure 5:
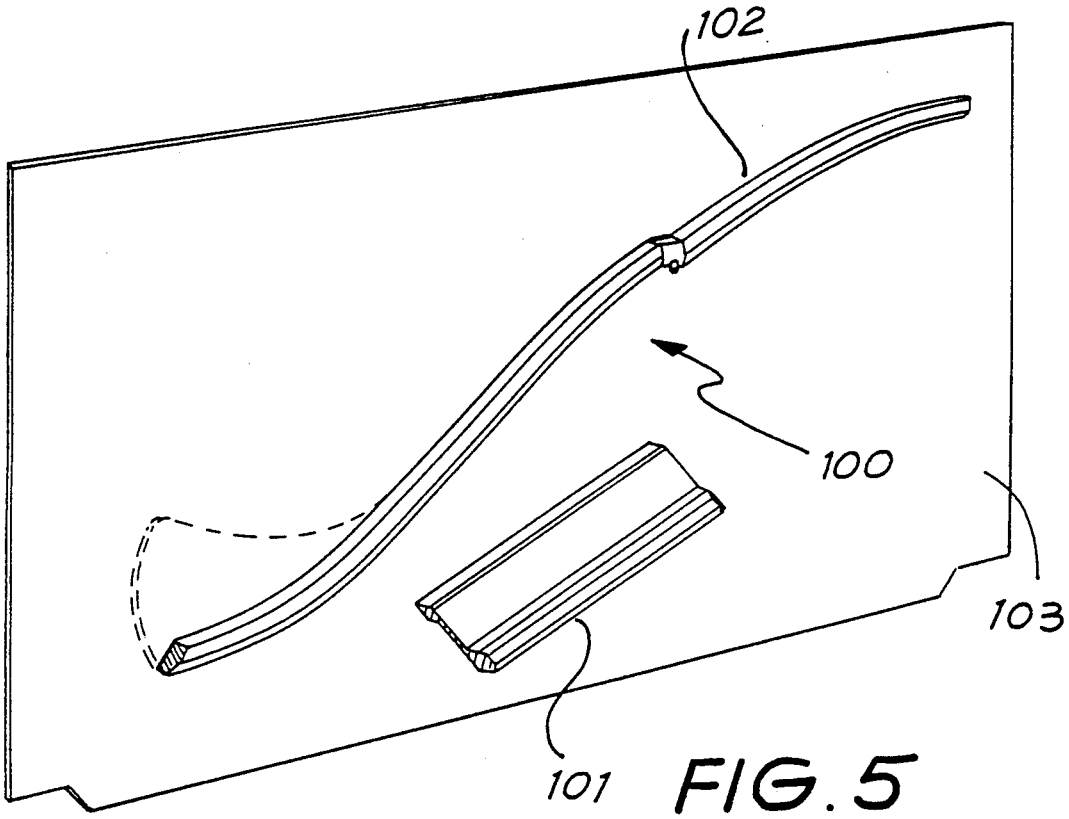
FIG. 5 shows a soundboard and bridge arrangement of a conventional piano.
Figure 6:
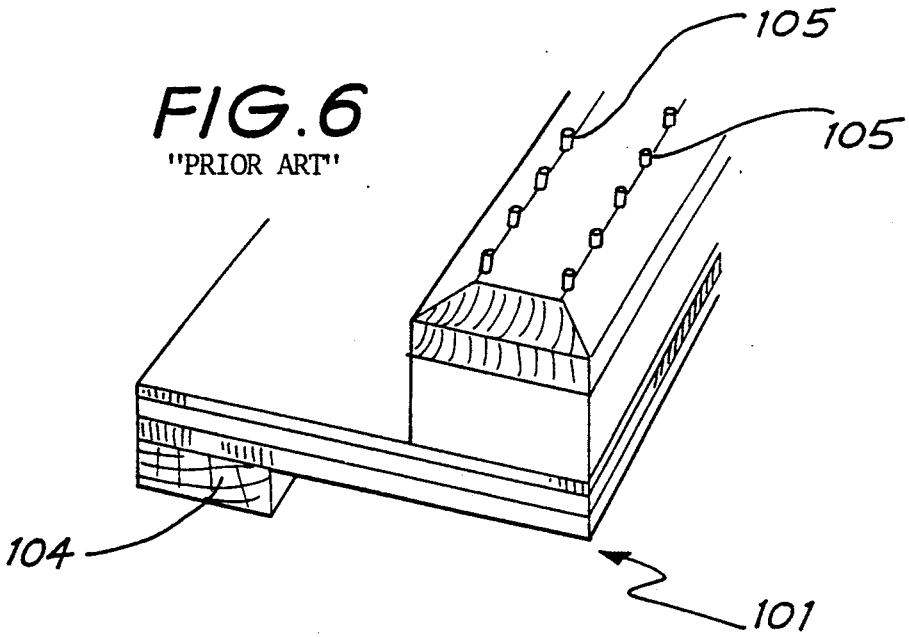
FIG. 6 shows a detailed view of a conventional bass bridge.

In the embodiment as illustrated in FIG. 4, the strings 24 at the strike point are angled as is the action, only the keybed 50 remains the same, horizontal.

With the strings 24 and the action at this or a similar degree from the vertical, gravity is able to influence the return movement to a greater extent than in a normal upright piano. This then increases the setoff pressure and decreases the hammer return time. Having the strings at this angle allows the keys to be longer when fitted in the same size cabinet.

FIGS. 7 to 10 illustrate preferred embodiments of a further aspect of the present invention which relates to soundboard and bridge arrangements.

Figure 7:
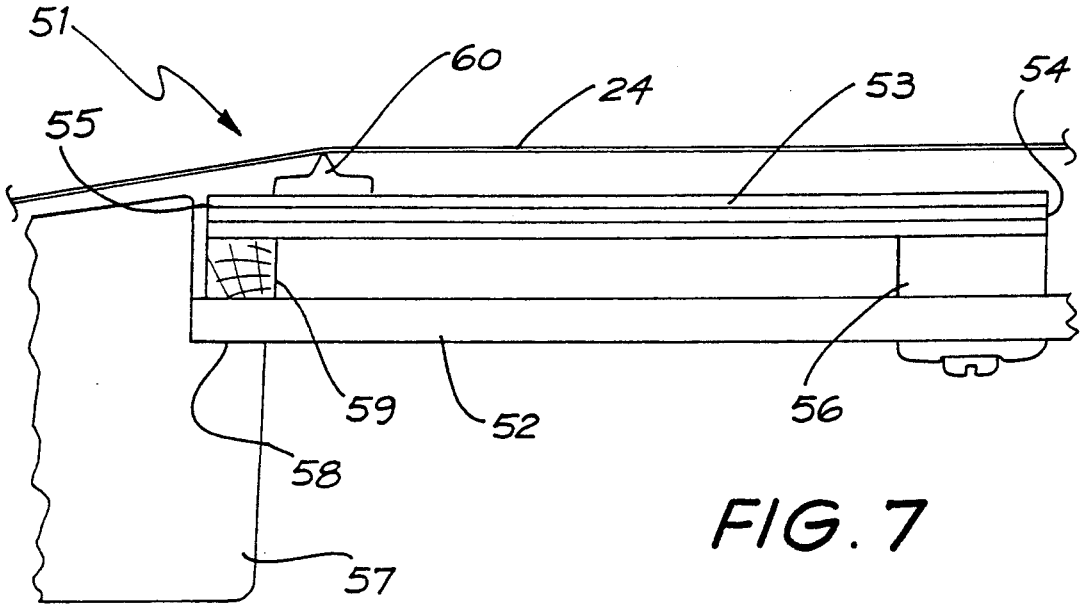
FIG. 7 illustrates a sectional view of a first embodiment of the bridge and soundboard arrangement of the piano of the present invention.

In FIG. 7, a bridge arrangement 51 is disclosed to enable the transfer of vibration of the string 24 to the soundboard 52.

The bridge arrangement 51 comprises a suspension bridge 53 which contacts the soundboard 52 along both its longitudinal edges (54 and 55). At the first longitudinal edge 54 the suspension bridge is arranged to contact the soundboard via bridge rail 56 in an active area of the soundboard. An active area of a soundboard is that portion which is free to vibrate and as such is able to resonate fully the note generated by the vibrating string 24.

As can be seen in FIG. 7, the soundboard 52 is mounted to the plate 57 and the second longitudinal edge 55 of the suspension bridge 53 is arranged to engage the portion 58 of the soundboard which is in contact with the plate 57. The second edge 55 contacts the soundboard 52 through pressure block 59.

A bridge bearing 60 is located on the suspension bridge 53 towards the second longitudinal edge 55 of the suspension bridge. The bridge bearing is arranged to engage the string 24 such that the vibration from the string is transferred through the bridge bearing 60, suspension bridge 53 and bridge rail 56 to the soundboard 52.

In the preferred embodiment the bridge bearing 60 is moveable to enable fine tuning of the soundboard arrangement. However, the bridge arrangement 51 could still work if the bridge bearing 60 was fixed to the suspension bridge 53.

The bridge arrangement 51 enables lower string tension to be applied to the soundboard 52 as the majority of the force from the tension of the strings 24 is imparted to the plate 53 due to the position of the bridge bearing 60. The effect of reducing pressure on the soundboard means that the ribs used to reinforce the strength of the soundboard to stop it from buckling under the string pressure can be reduced or omitted. As a result the soundboard is able to have improved flexibility and resonance properties which improve the vibration (or sound) transfer.

Furthermore, with the bridge arrangement 51 having the suspension bridge supported at both its longitudinal edges 54 and 55, the bridge bearing 60 is able to be positioned at a much greater distance from the point of contact of the bridge arrangement with the soundboard 52 (ie. at the bridge rail 56). In this way, the speaking length of the string is increased. Further, the location of the bridge bearing on the suspension bridge 53 causes the string vibration to be magnified towards the bridge rail 56 and diminish towards the plate 57.

Figure 8:
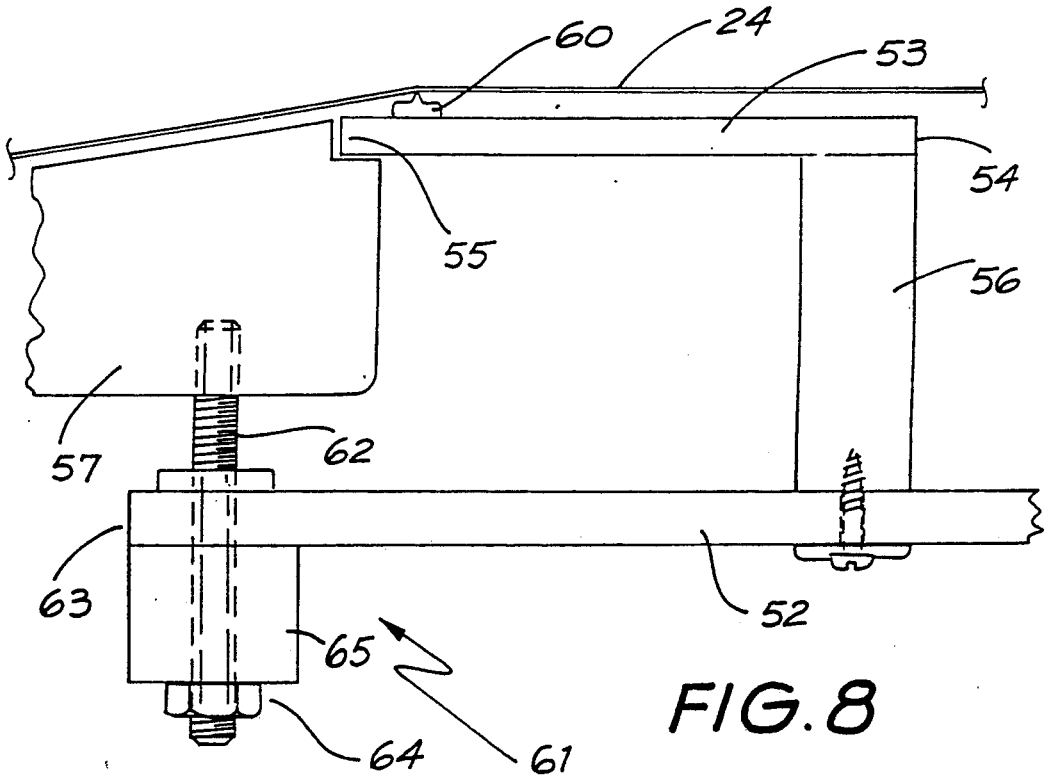
FIG. 8 illustrates a sectional view of a second embodiment of the bridge and soundboard arrangement of the piano of the present invention.

FIG. 8 illustrates a second embodiment of the bridge arrangement 51. In this arrangement, the soundboard 52 is held in fixed space relationship to the plate 57 by way of a series of adjustable mounting means 61. The adjustable mounting means 61 are in the form of a threaded bolt 62 screwed into the frame and passing through an edge 63 of the soundboard 52. The soundboard is held in location by nuts 64 fitted to the bolts 62. The bolts 62 also pass through the rim 65 of the soundboard 52. If the rim 65 is extended away from the soundboard in a plane parallel to the soundboard, the rim 65 may be connected directly to the cabinet of the piano and not to the plate 57 or be connected to posts connected to the cabinet.

The only other difference between the bridge arrangement 57 shown in FIG. 8 and the arrangement shown in FIG. 7 is that the suspension bridge 53 is connected at its second end 55 directly to the plate 57.

The arrangement as shown in FIG. 8 allows the soundboard to be quickly fitted to the plate and held in a desired space relationship therefrom and if adjustment to the clearances between the plate 57/strings 24 and the soundboard 52 is required, it can be quickly effected without removing the soundboard.

Furthermore, as the soundboard needs only to be held in spaced relationship with the plate 57, it can be directly supported by a frame secured to the plate or even to the same frame which holds the plate in the piano so constructed.

The bridge arrangement as shown in FIGS. 7 and 8 can be incorporated in an upright piano such that a single bridge arrangement replaces the bass and treble bridge of conventional pianos.

Figure 9:
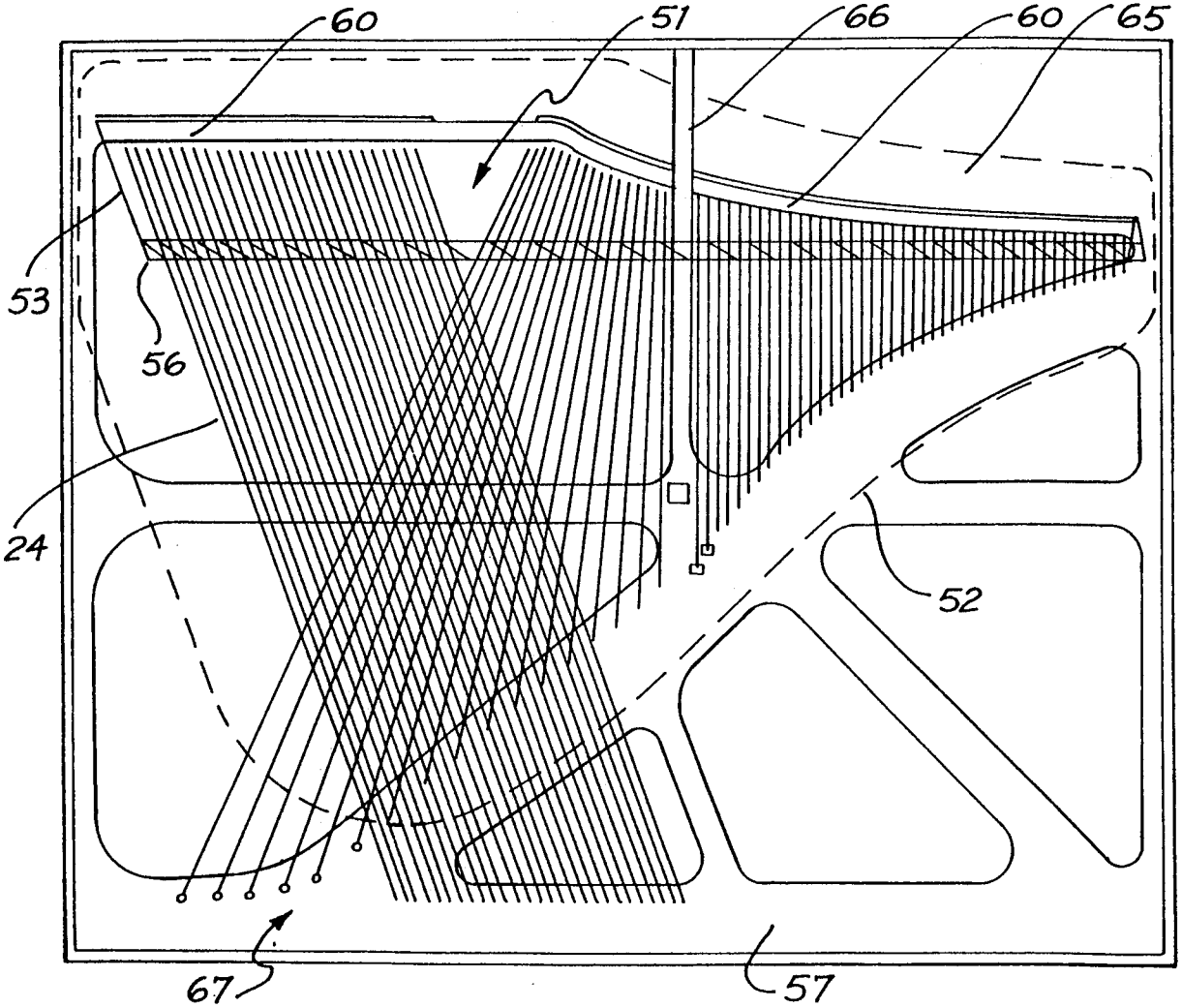
FIG. 9 illustrates a front view of the bridge and soundboard of the piano of the present invention fitted in an upright piano plate.

As illustrated in FIG. 9, the bridge arrangement 51 is fitted to an upright piano to the upper end of the plate 57 adjacent the tuning pins 65. The suspension bridge 53 is secured at the second longitudinal edge 55 to the plate 57 and extends towards the bottom of the plate 57. The bridge rail 56 extends inwardly from the suspension bridge 53 and contacts the soundboard 52 (as shown in phantom).

The suspension bridge 53 also extends across the whole of the plate 57. Reinforcing bar 66 of the plate 57 is cast in a raised position such that the bridge arrangement 51 can be located underneath. Bridge bearings 60 are located on the suspension bridge 53 and are arranged to contact the strings 24.

The strings 24 shown in FIG. 9 are illustrated to show their speaking length only. As can be seen the speaking length of the string is increased as the speaking length extends from the bridge bearing 60 to the hitch pins 67.

Furthermore, as a single bridge arrangement 51 replaces the conventional bass and treble bridge, the bridge arrangement 51 has improved qualities in the transfer and mixing of vibrations, especially in the area of the upper end of the bass strings and lower end of the treble strings.

The reduction in pressure on the soundboard 52 enables the soundboard to be more readily shaped as shown in FIG. 9 to reduce the size of the areas not influenced by the vibration of the strings so that the shape of the soundboard of the upright piano is more akin to the shape of a soundboard of a grand piano. Consequently, the sound quality of the upright piano can more closely resemble the characteristic sound of a grand piano.

Figure 10:
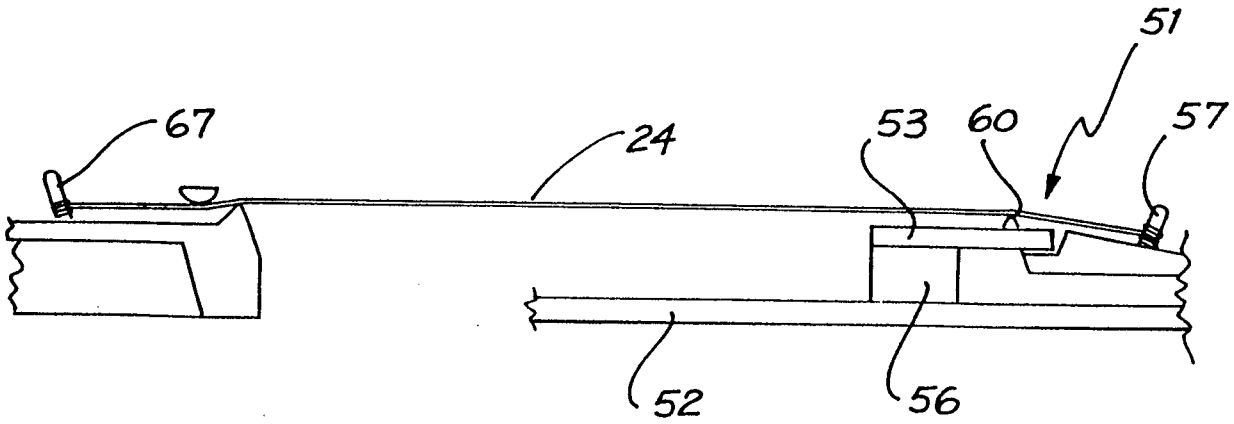
FIG. 10 illustrates the bridge and soundboard arrangement of FIG. 7, arranged in a grand piano.

FIG. 10 illustrates the bridge arrangement 51 incorporated at the lower end of the plate 57. It is noted that the bridge arrangement 51 could be used at the lower end or end remote from the tuning pins 67 of a plate in either a grand or upright piano. When used at the lower end of the plate 57 it is necessary to incorporate two bridge arrangements 51, one for the bass strings and the other for the treble strings.

Again when incorporated at the lower end of the plate 57, the bridge arrangement enables the speaking length of the strings to be increased and furthermore, the pressures on the soundboard 52 are reduced.

Although the invention has been described with reference to specific examples it will be appreciated by those skilled in the art that the invention may be embodied in many other forms.

I claim:

1. An upright piano action for a piano incorporating a piano frame, the action comprising a hammer butt rotatably secured relative to the frame, a shank mounted to the hammer butt and supporting a hammer head thereon remote from the hammer butt, the hammer butt being rotatable between a rest position wherein the hammer head is remote from a string of the piano and a string striking position wherein the hammer head strikes the string, a jack engaging the hammer butt when in the rest position and being arranged to cause the hammer butt to rotate from its rest position to the string striking position by depression of a respective key of the piano, biasing means acting on the hammer butt to bias the hammer butt from the string striking position to the rest position, the biasing means being arranged to apply a first force at a first location on the hammer butt when the hammer butt is in or adjacent its rest position and to apply a second force at a second location on the hammer butt when the hammer butt rotates from the rest position to an intermediate position between the rest and string striking positions, the first location on the hammer butt being remote from the second location and wherein the moment of force generated by the biasing means to bias the hammer butt from the string striking position to the rest position is greater when the biasing means applies the second force on the second location of the hammer butt, than when the biasing means applies the first force on the first location of the hammer butt.

2. A piano action as claimed in claim 1, wherein the jack is further arranged such that as the hammer butt moves from the rest position to the string striking position, the jack is caused to disengage the hammer butt, the biasing means being further arranged to apply the second force on the second location on the hammer butt immediately before the jack disengages the hammer butt.

3. An upright piano action for a piano incorporating a piano frame, the action comprising a hammer butt rotatably secured relative to the frame, a shank mounted to the hammer butt and supporting a hammer head thereon remote from the hammer butt, the hammer butt being rotatable about a pivot axis between a rest position wherein the hammer head is remote from a string of the piano and a string striking position wherein the hammer head strikes the string, a jack engaging the hammer butt when in the rest position and being arranged to cause the hammer butt to rotate from its rest position to the string striking position by depression of a respective key of the piano, biasing means acting on the hammer butt to bias the hammer butt from the string striking position to the rest position, the biasing means being arranged to apply a first force at a first location on the hammer butt when the hammer butt is in or adjacent its rest position and to apply a second force at a second location on the hammer butt when the hammer butt rotates from the rest position to an intermediate position between the rest and string striking positions, the first location on the hammer butt being adjacent said pivot axis and the second location being remote from said pivot axis in a direction perpendicular to the pivot axis such that the moment of force generated by the biasing means to bias the hammer butt from the string striking position to the rest position is greater when the biasing means applies the second force on the second location of the hammer butt, than when the biasing means applies the first force on the first location of the hammer butt.

4. A piano action as claimed in claim 3, wherein the jack is further arranged such that as the hammer butt moves from the rest position to the string striking position, the jack is caused to disengage the hammer butt, the biasing means being further arranged to apply the second force on the second location on the hammer butt immediately before the jack disengages the hammer butt.

5. A piano action as claimed in claim 4, wherein the biasing means comprises a wire spring which is arranged to contact the hammer butt at the first location when the hammer butt is in the rest position and to contact a bearing mounted to the hammer butt at the second location when the when the hammer butt moves to the intermediate position.

6. A piano action as claimed in claim 5, wherein the position of the bearing on the hammer butt is adjustable.

7. A piano action as claimed in claim 4, wherein the biasing means comprise a wire spring having first and second bearings located thereon, the first bearing being arranged to contact the hammer butt at the first location when the hammer butt is in the rest position and the second bearing being arranged to contact the hammer butt at the second location when the hammer butt moves to the intermediate position.

8. A piano action as claimed in claim 7, wherein the position of second bearing on the wire spring is capable of being adjusted.

9. A piano action comprising a keyboard having keys thereon, a wippen hinged to a main action rail means causing movement of said wippen by a key, a jack hingedly connected to said wippen, a hammer hinged relative to said main action rail, said hammer having a hammer butt, said jack engaging said hammer butt to cause striking movement of said hammer, a back stop on said hammer butt and a back check block attached to said wippen, characterised by a repetition spring means acting between said jack and said main action rail, an adjustable jack spring acting between said jack and said wippen, whereby on repetitive playing said jack is disengaged from said butt and re-engaged with said butt under influence of said springs without the key being fully returned.

10. A piano action as defined in claim 9 further characterised by a hammer return spring attached to a return spring rail, said hammer return spring being attached at a low point on said butt, said butt at its upper end having a setoff bearing to engage said return spring.

11. A piano action as defined in claim 10 further characterized by an adjustable setoff button fixed to the main action rail, said setoff button being contacted by a lever on said jack as said key reaches its full depression to release said jack from said butt whereby said repetition spring means returns said jack to engage said butt against the pressure of said return spring.

12. A piano action as defined in claim 9 characterized in that said action is installed in a piano having strings inclined to the vertical, said strings being in a plane inclined so that the top of the strings are nearer the keyboard than the bottom thereof whereby gravity assists the return movement of the hammers.

13. An upright piano action according to claim 2, further incorporating damping means comprising:

a damper locked onto a damper main rail, said damper main rail being rigidly attached to a piano plate;

actuating means which pivots around said damper main rail, imparting movement to said damper towards a string.

* * * * *